US007686683B2

(12) United States Patent
Duhamel et al.

(10) Patent No.: US 7,686,683 B2
(45) Date of Patent: Mar. 30, 2010

(54) METHOD OF PLAYING A GAME WITH A MULTI-ACCESS SELECTION FEATURE

(75) Inventors: Gérald Duhamel, Drummondville (CA); Marie-Claude Gagnon, Drummondville (CA)

(73) Assignee: Labtronix Concept Inc., Drumondville, Quebec (CA)

( * ) Notice: Subject to any disclaimer, the term of this patent is extended or adjusted under 35 U.S.C. 154(b) by 1255 days.

(21) Appl. No.: 11/036,210

(22) Filed: Jan. 18, 2005

(65) Prior Publication Data

US 2005/0159201 A1 Jul. 21, 2005

Related U.S. Application Data

(60) Provisional application No. 60/536,511, filed on Jan. 15, 2004.

(51) Int. Cl.
*A63F 9/24* (2006.01)

(52) U.S. Cl. ..... 463/16; 463/20

(58) Field of Classification Search ..... 463/20, 463/26

See application file for complete search history.

(56) References Cited

U.S. PATENT DOCUMENTS 5,042,809 A 8/1991 Richardson
5,046,737 A 9/1991 Fienberg
5,411,271 A 5/1995 Mirando
5,564,700 A 10/1996 Celona
5,707,285 A 1/1998 Place et al.
5,919,088 A 7/1999 Weiss
5,947,820 A 9/1999 Morro et al.
5,997,401 A 12/1999 Crawford
6,068,553 A 5/2000 Parker
6,312,334 B1 * 11/2001 Yoseloff ..... 463/25
6,572,471 B1 6/2003 Bennett
6,645,074 B2 * 11/2003 Thomas et al. ..... 463/20
6,726,563 B1 4/2004 Baerlocher et al.
2003/0027619 A1 2/2003 Nicastro
2003/0216167 A1 11/2003 Gauselmann
2004/0063493 A1 4/2004 Baerlocher
2004/0242296 A1 12/2004 Nelson et al.

* cited by examiner

*Primary Examiner*—Corbett B Coburn
(74) *Attorney, Agent, or Firm*—C. Marc Benoit; Benoit & Cote s.e.n.c.

(57) ABSTRACT

Method of playing a multi-access feature game played along with a primary game. The method comprises: a) playing a primary game, b) initiating feature-game play process upon occurrence of a trigger outcome in the primary game, and c) allowing a player to play the feature game. The latter comprises: i) determining an access type associated with the triggering outcome among many types associated with distinct permissions, ii) providing a feature-game representation composed of a plurality of selectable objects having values and positions, the objects being displayed according to a state based on previous plays of the feature game, iii) receiving a player selection of an object according to a determined permission, iv) affecting the selection according to permission associated with the access type, and modifying selected object status accordingly, v) registering the status and position of all of the feature-game selectable objects, and vi) resuming the primary game.

6 Claims, 4 Drawing Sheets

METHOD OF PLAYING A GAME WITH A MULTI-ACCESS SELECTION FEATURE

CROSS-REFERENCE TO RELATED APPLICATIONS

This application claims priority under 35USC §119 (e) of U.S. provisional patent application 60/536,511 filed Jan. 15, 2004, the specification of which is hereby incorporated by reference.

TECHNICAL FIELD

The present invention relates to a game using a multi-access selection feature.

BACKGROUND OF THE INVENTION

Gambling has evolved a lot during the last few years, and game manufacturers are always searching for new methods to interest and entertain players. Players are always demanding more features and payout schemes.

Improvements in these kinds of games are desired to enhance the player's interest and entertainment.

SUMMARY OF THE INVENTION

In accordance with an embodiment of the present invention, there is provided a method of playing a multi-access selection feature played along with a primary game. This method comprises; providing a game outcome in the primary game; and determining whether game data associated with the game outcome comprise a triggering outcome providing access to the selection feature. If the triggering outcome determination is positive, the method also comprises determining a type for the access to the selection feature and providing access to the selection feature according to permissions associated with the determined type of access.

In accordance with another embodiment of the present invention, there is provided a method of playing a shared multi-access selection feature played on a plurality of gaming machine and comprising: providing a game outcome in a primary game; and determining whether game data associated with said game outcome comprise a triggering outcome providing access to the shared selection feature, If the triggering outcome determination is positive, the method also comprises determining a type for the access to the shared selection feature; and providing access to the shared selection feature according to permissions associated with the determined type of access.

In accordance with another embodiment of the present invention, there is provided a game apparatus comprising: display means to display a game outcome in a primary game; determination means to determine whether game data associated with the game outcome comprise a triggering outcome providing access to a multi-access selection game, and to determine a type of access to the selection feature; and controlling means to provide access to the selection feature according to permissions associated with the determined type of access.

In accordance with another embodiment of the present invention, there is provided a computer program embodied on a computer readable medium or in processor-readable memory having codes adapted to: provide a game outcome in a primary game; and determine whether game data associated with the game outcome comprise a triggering outcome providing access to a multi-access selection feature. If the triggering outcome determination is positive, the computer program also has codes adapted to determine a type for the access to the selection feature; and provide access to the selection feature according to permissions associated with the determined type of access.

In accordance with another embodiment of the present invention, there is provided a computer program carried on an electrical or electro-magnetic carrier signal having codes adapted to: provide a game outcome in a primary game; and determine whether game data associated with the game outcome comprise a triggering outcome providing access to a multi-access selection feature. If the triggering outcome determination is positive, the computer program also has codes adapted to determine a type for the access to the selection feature; and provide access to the selection feature according to permissions associated with the determined type of access.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
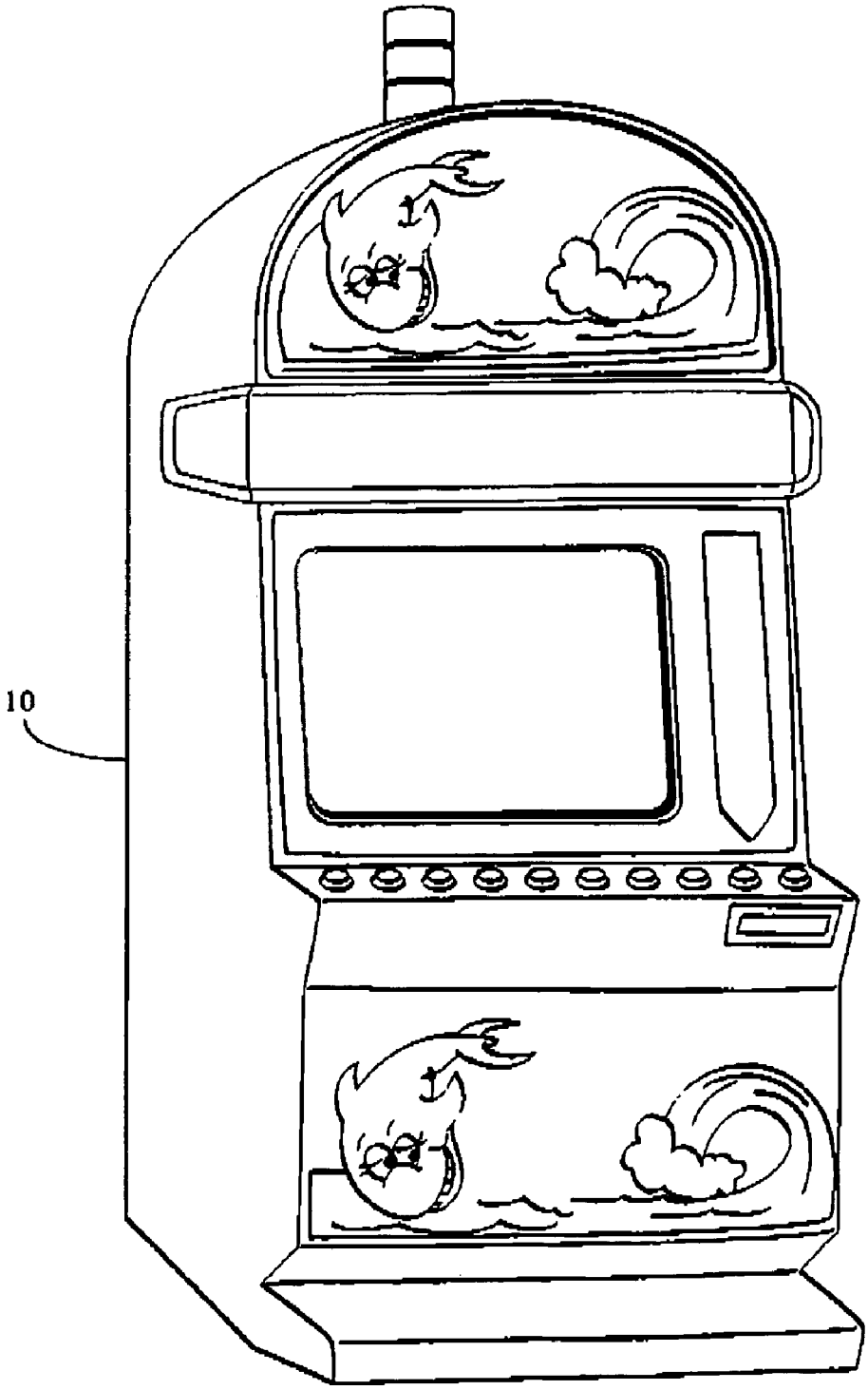
FIG. 1 is a schematic diagram showing a perspective view of a gaming machine suitable for the present invention.
Figure 2:
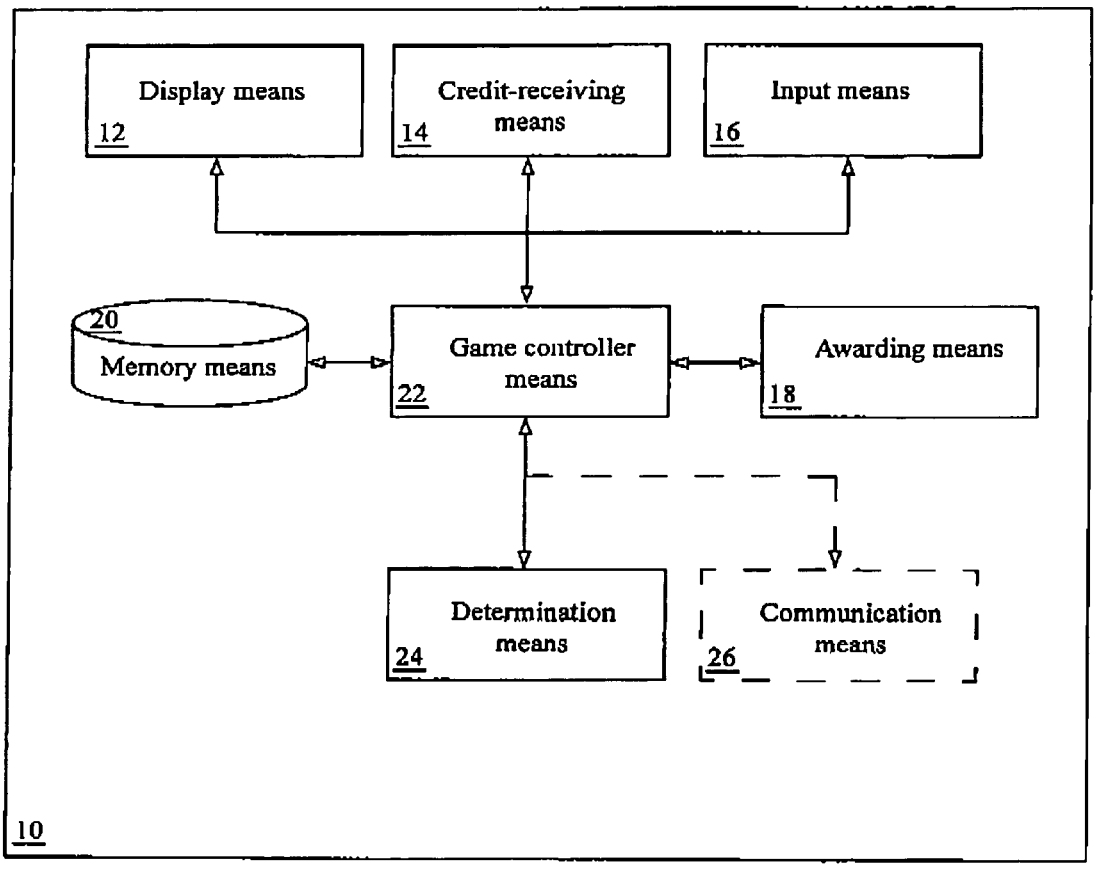
FIG. 2 is a bloc diagram illustrating the components of the gaming machine of FIG. 1.

The present invention is preferably carried out on a gaming machine, as illustrated in FIGS. 1 and 2. Said gaming machine 10 comprises display means 12, such as a video screen, an LCD screen or mechanical reels; credit-receiving means 14 such as a card reader, or a coin and/or bill acceptor; input means 16, such as buttons, levers or a touch screen; awarding means 18, such as a ticket printer, a card reader or a hopper; memory means 20; a game controller means 22; determination means 24, and optionally, communication means 26.

The invention may also be applied in a computer program, or at a remote terminal, the game information (not shown) being distributed via a network, such as linked machines or the Internet, or broadcasted using an electrical or electro-magnetic signal.

Figure 3:
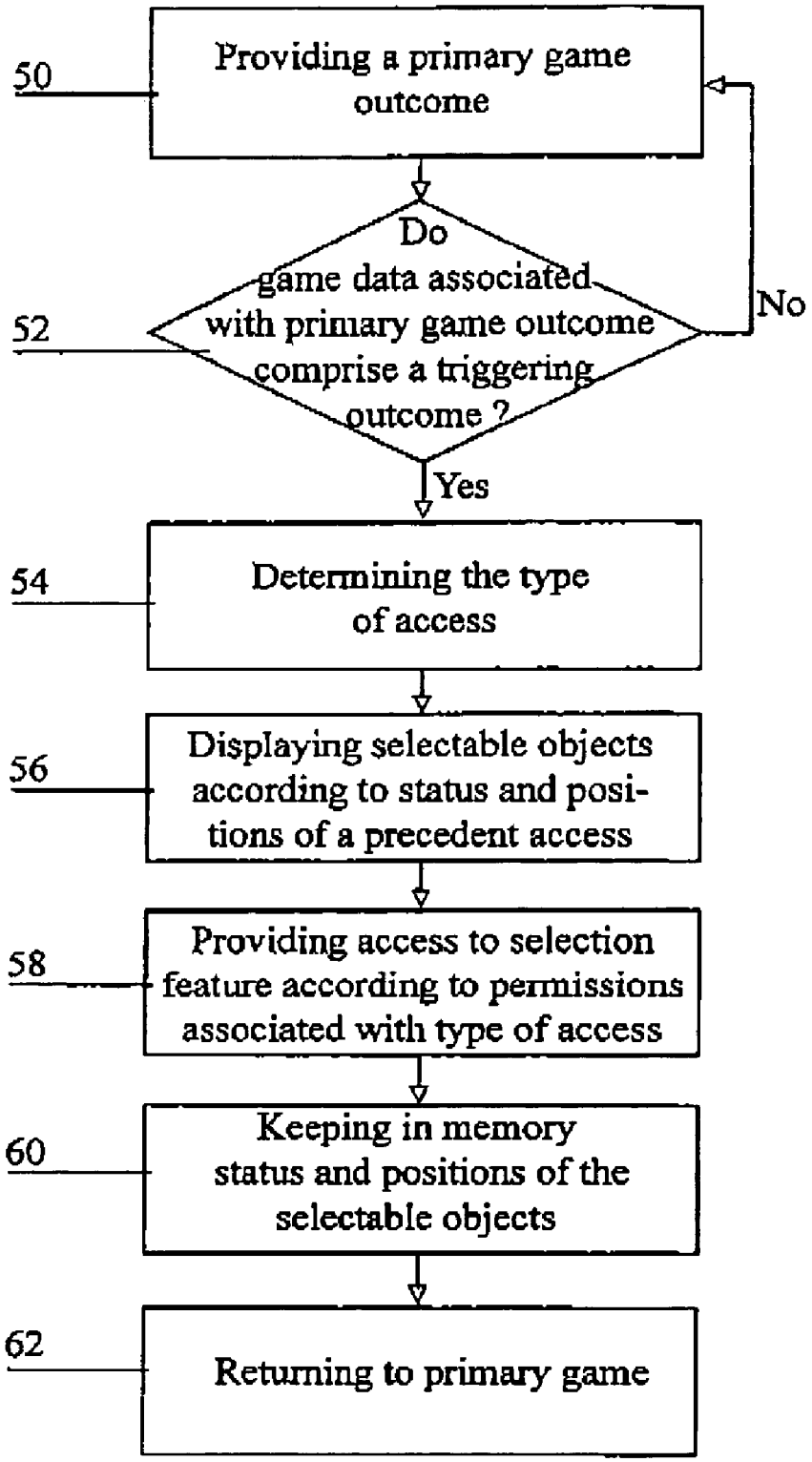
FIG. 3 is a flowchart illustrating the steps of a simple embodiment of the present invention as played on the gaming machine of FIGS. 1 and 2.

FIG. 3 illustrates the steps of a simple embodiment of the present invention. After a primary game outcome is provided (step 50), it is determined whether the game data (bet value, game level, game indicia forming the game outcome, the game result, the prize value, number of plays or time elapsed since a precedent access, etc.) comprise a selection feature triggering outcome (step 52). If the determination is positive, it is determined which type of access is provided (step 54) and the selectable objects are displayed according to their status and positions at the end of a precedent access (step 56). Access to the selection feature is provided according to the permissions associated with the determined type of access (step 58) and the status and positions of the selectable objects at the end of the current access are kept in memory (step 60). The player is returned to the primary game (step 62).

Figure 4:
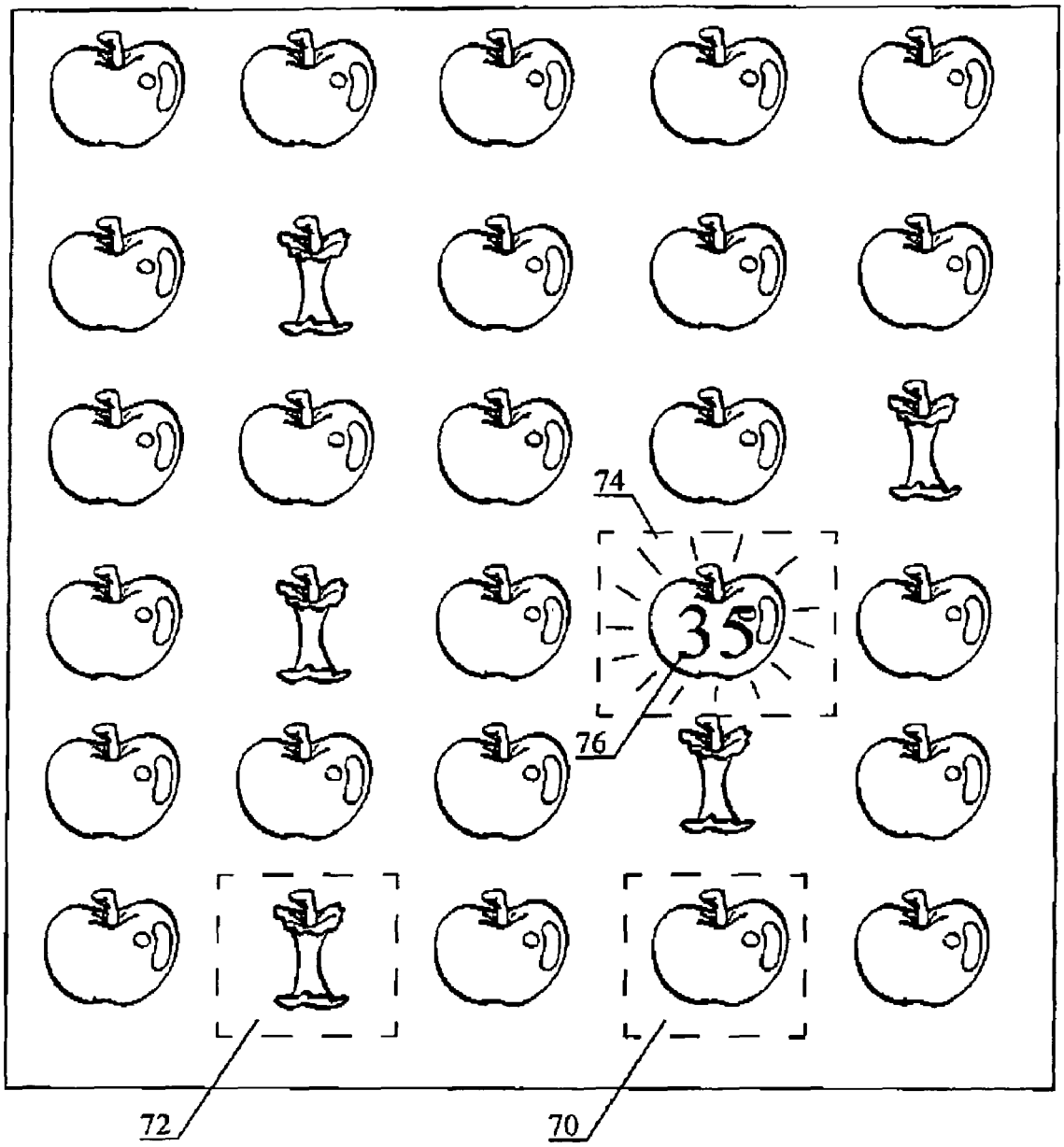
FIG. 4 is a screen shot of a game played in accordance with a simple embodiment of the present invention.

FIG. 4 illustrates a screen shot of a typical multi-access selection feature. This feature consists in providing a plurality of selectable objects having hidden associated values. When the player accesses the selection feature, he or she selects at least one selectable object which will be affected according to the permissions associated with the provided type of access. Accordingly, the selected object associated value may be revealed or awarded to the player, or the selected object status or position may be modified, becoming unavailable for selection for example. In the illustrated example, the object 70 is available for selection while the object 72 is not. The object 74 is the latest selected object, with the object value 76 being revealed.

The selection feature is triggered when the game data comprise a triggering outcome. The game data associated with the game outcome are at least one of: a) the bet value placed by the player to play the game; b) the game level selected by the player, in a line game this game level would be the number of lines on which a bet is placed, while in a keno game it would be the number of selected numbers; c) the game indicia participating in the game outcome, these game indicia may also be limited to the game indicia participating in the triggering outcome when the triggering outcome is a indicia-based outcome; d) the game results after the game outcome has been evaluated according to game rules, for example, in a poker game, the game result would be the hand ranking; e) the prize value associated with the game outcome; f) the number of play since a precedent access to the selection feature, usually the last but may also be last access with a certain type of access; and g) a length of time elapsed since a precedent access to the selection feature, usually the last but may also be last access with a certain type of access Upon occurrence of a triggering outcome, the type and the number of accesses are determined in many ways. This selection may be random, based on at least part of the game data associated with the primary game outcome, such as the indicia participating in the triggering outcome, or based on a number of accumulated accesses. For example, after having accessed the selection feature according to a certain type of access five (5) times, the sixth access would be applied according to the permissions associated to another predetermined type of access.

A selection feature has a certain number of types of accesses, each associated with predetermined permissions, allowing the player to have a predetermined impact on the selectable objects. One simple permission is an "award". According to this permission, the player is awarded the value associated with the selected object.

Another permission is a "seeking" permission, wherein the value associated with the object selected by the player is revealed, without being awarded to the player. By learning the associated value of at least one object, the player may decide to select or to avoid selecting this object whenever he is provided an "award" access to the selection feature.

A third permission is a "control" permission. This permission allows the player to modify the position or status of a selectable object. For example, the player may "ground" a selectable object, preventing it from being moved during a certain number of subsequent accesses or until the end of the selection feature. This permission also comprises allowing the player to switch the positions of two selectable objects.

A fourth permission affects part or all of the selectable objects without individual selections either in their status or their position. Examples of this permission are a shuffle of all the selectable objects, or a "shaker" which allows a random number of selectable objects to be shuffled.

Another permission is a "reset". When this permission is associated with a provided access, the multi-access selection feature returns to its initial state, with all selectable objects returning to their initial positions and status.

A combination of permissions may be associated with a type of access. For instance, a player may be provided a "seeking" permission and an "award" permission when a certain type of access is provided. The order in which these permissions are applied may either be imposed or be left to the player to decide.

In the present exemplary embodiment, prizes are awarded both in the primary game, upon occurrence of a winning primary game outcome, and when accessing the selection feature with an access having an "award" permission. The preferred embodiment comprises a line primary game and an instant prize selection feature, but other embodiments may be applied according to the present invention, among them a poker, a blackjack, a lotto, a keno or a bingo primary game.

While the above description presents the multi-access selection feature as applied on a single gaming machine, it may also be shared on a plurality of gaming machines. According to this last embodiment, a communication network links the plurality of gaming machines. A central server, or one of the gaming machines, stores and distributes to the gaming machines, upon occurrence of triggering outcomes, the selection feature data comprising the selectable objects positions, statuses and associated values. Thus, even though the primary game is individually provided by each gaming machine, the selection feature is shared by the plurality of machines and an access provided on a gaming machine has an impact on the selectable objects accessed by any gaming machine during a subsequent access.

While illustrated in the block diagrams as groups of discrete components communicating with each other via distinct data signal connections, it will be understood by those skilled in the art that the preferred embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present preferred embodiment.

It should be noted that the present invention can be carried out as a method, can be embodied in a system, a computer readable medium, processor-readable memory or an electrical or electromagnetic signal.

The embodiments of the invention described above are intended to be exemplary only. The scope of the invention is therefore intended to be limited solely by the scope of the appended claims.

We claim:

1. A method of playing a multi-access selection feature played along with a primary game and during which at least one object is selected, said method comprising: on a gaming machine, providing at least two types of access, each associated with at least one permission;

providing game outcomes in said primary game;

generating a selection feature play as a plurality of selectable objects, each associated with a value, a position and a status, said selection feature play being accessible a plurality of times during conduct of said primary game; and for each access to said selection feature play, occurring upon determination of a selection feature triggering outcome in said primary game:

determining a type of access for said access based on game data associated with said selection feature triggering outcome;

displaying said selection feature play according to either (a) initial positions and statuses if said access is a first access to said generated selection feature play; or (b) positions and statuses kept in memory at the end of a precedent access to said selection feature play;

providing access to said selection feature play during which each selectable object selected by a player is affected according to permissions associated with the determined type of access;

allowing the player to make at least one selection of a selectable object according to said permissions associated with the determined type of access and modifying the status or position of said selected selectable objects according to said permissions;

keeping in memory the status and position of each of said selectable objects of said selection feature play; and returning to said primary game.

2. The method of claim 1, further comprising:

displaying said selection feature as a plurality of selectable objects according to status and positions at the end of a precedent access to said selection feature;

keeping in memory the status and position of each of a plurality of selectable objects at the end of the current access; and returning to said primary game.

3. The method of claim 1, wherein game data comprises at least one of a) a bet value; b) a game level; c) a game indicia; d) a game result; e) a prize value; f) a number of plays since a precedent access to said selection feature; and g) a length of time elapsed since a precedent access to said selection feature.

4. The method of claim 1, wherein the step of determining the type of access is applied according to at least one of: a) a random determination; b) at least part of said game data; c) a predetermination based on a number of accumulated accesses.

5. The method of claim 1, further comprising associating each type of access with at least one of the following permissions: a) allowing the player to learn a selectable object associated value; b) allowing the player to be awarded a selectable object associated value; c) allowing the player to affect a selectable object in its status or position; d) allowing the player to affect part or all selectable objects in their statuses or positions; e) allowing the player to create or remove selectable objects; and f) allowing the player to reset said selection feature.

6. The method of claim 1, further comprising awarding a prize in said primary game.

* * * * *